United States Patent [19]

Collins et al.

[11] Patent Number: 4,569,033

[45] Date of Patent: Feb. 4, 1986

[54] OPTICAL MATRIX-MATRIX MULTIPLIER BASED ON OUTER PRODUCT DECOMPOSITION

[75] Inventors: William C. Collins, Alexandria, Va.; P. Denzil Stilwell, Jr., Walkersville, Md.; Ravindra A. Athale, Annandale, Va.

[73] Assignee: The United States of America as represented by the Secretary of the Navy, Washington, D.C.

[21] Appl. No.: 504,331

[22] Filed: Jun. 14, 1983

[51] Int. Cl.[4] ..... G06G 7/161

[52] U.S. Cl. ..... 364/845; 364/713

[58] Field of Search ..... 364/713, 845, 837

[56] References Cited

U.S. PATENT DOCUMENTS 4,009,380 2/1977 Bocker et al. ..... 364/837

OTHER PUBLICATIONS

A. R. Dias, Incoherent Matrix-Matrix Multiplier, NASA Conference Publication 2207, (1981), pp. 71–83.

A. Tarasevich et al., Matrix Vector Multiplier . . . NASA Conference Publication 2207 (1981), pp. 61–70.

H. J. Caulfield et al., Optical Implementation of Systolic Array Processing, Optics Communications, vol. 40, No. 2 (1981), pp. 86–90.

Ravindra A. Athale et al., Optical Matrix-Matrix Multiplier based on Outer Product Decomposition, Applied Optics, vol. 21, No. 12 (Jun. 15, 1982), pp. 2089–2090.

Fan, "Optical Matrix Inverter", *IBM Technical Disclosure Bulletin*, vol. 6, No. 1, Jun. 1963, p. 131.

Tamura et al, "Two-Dimensional Matrix Multiplication Using Coherent Optical Techniques", *Optical Engineering*, vol. 18, No. 2, Mar.–Apr. 1979, pp. 198–204.

*Primary Examiner*—David H. Malzahn

*Attorney, Agent, or Firm*—Robert F. Beers; William T. Ellis; Charles S. Guenzer

[57] ABSTRACT

An optical matrix multiplier using two linear modulating arrays in which the columns of the first matrix to be multiplied control the modulation of one array and the rows of the second matrix control the other array. Light is directed through all combinations of elements on the two arrays and the resultant beams measured by individual elements on a two-dimensional detector array. The detecting elements time integrates the intensity of light falling on each of them, which value corresponds to an element of the product of the two matrices. The invention may be implemented among other ways with two linear electrooptical arrays, a linear array of light emitting diodes and a linear electrooptical array, or two Bragg cells and a pulsed light source.

9 Claims, 3 Drawing Figures

OPTICAL MATRIX-MATRIX MULTIPLIER BASED ON OUTER PRODUCT DECOMPOSITION

BACKGROUND OF THE INVENTION

1. Field of the Invention

The field of the invention in general is optical processing and in particular is multiplication of two matrices by optical techniques.

2. Description of the Prior Art

The product of two matrices is often required in mathematical analysis, particularly in the reduction of numerical data, 2-dimensional transforms, matrix inversion and pattern recognition. An N×N square matrix A is composed of $N^2$ elements commonly represented as $$\underline{A} = \begin{pmatrix} a_{11} & a_{12} \cdots & a_{1N} \\ a_{21} & a_{22} \cdots & a_{2N} \\ \cdot & \cdot & \cdot \\ \cdot & \cdot & \cdot \\ \cdot & \cdot & \cdot \\ a_{N1} & a_{N2} & a_{NN} \end{pmatrix} \quad (1)$$

Similar representations are used for matrices B and C.

The product of the two matrices A and B is concisely written as $$C = A\,B \quad (2)$$

The elements of the product C are given by the expression $$c_{ij} = \sum_{n=1}^{N} a_{in} b_{nj} \quad (3)$$

The matrix multiplication represented in Eqn. (3) is commonly performed on digital computers. However, a separate N-fold multiplication and sum for each of the $N^2$ elements of C needs to be performed. Where large amounts of data needs to processed, the multiplication represented by Eqn. (3) may be too slow for the desired data processing rates.

The use of optical techniques has been suggested for matrix multiplication which would not only be fast but would allow parallel processing for many of the elements of the product matrix C. Many of these schemes involve either a two-dimensional array of modulated light or a two-dimensional array or mask of spatial light modulators. Such 2-D arrays cannot be updated at speeds high enough to provide a truly high speed matrix-matrix multiplication.

An alternative approach has been described by Caulfield et al. in Optics Communications, volume 40, number 2, pages 86–90, 1981 in a technique called systolic array processing The matrix C can be represented as N vectors, for instance each of N columns is a separate vector. Then the jth column of C can be computed as a vector-matrix multiplication of the matrix A and the vector of the jth column of B. Caulfield et al. provide optical techniques for the resultant vector-matrix multiplication using linear or 1-D arrays of light emitting diodes (LEDs) and acoustooptic modulators. The matrix C is then computed one column at a time. However, such a processor requires 2N-1 parallel channels for N×N matrices and takes 4N clock cycles to perform one vector-matrix multiplication. Thus, it does not fully utilize the parallel processing capabilities of optical systems.

SUMMARY OF THE INVENTION

Accordingly, one object of the invention is to provide a fast matrix-matrix multiplier.

Another object of the invention is to provide a matrix-matrix multiplier that provides parallel processing for the elements of the product array.

A further object of the invention is to provide a matrix-matrix multiplier that uses optical components for the input data of no greater complexity than a linear array.

The invention is an optical multiplier of two N×N matrices using outer product decomposition which uses two crossed linear arrays of modulators. The rows of one matrix are used to sequentially control the N elements of one modulator array while the columns of the other matrix are simultaneously controlling the other modulator array. Light from each of the elements of the first modulator array are directed through each of the elements of the second modulator array. An N×N detector array is disposed to receive on separate elements thereof the light through all possible combinations of elements in the two modulator arrays. The elements of the detector array integrate the light intensities over the time all the rows and columns of the matrices control the modulation. The integrated intensities are proportional to the values of the elements in the product matrix.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
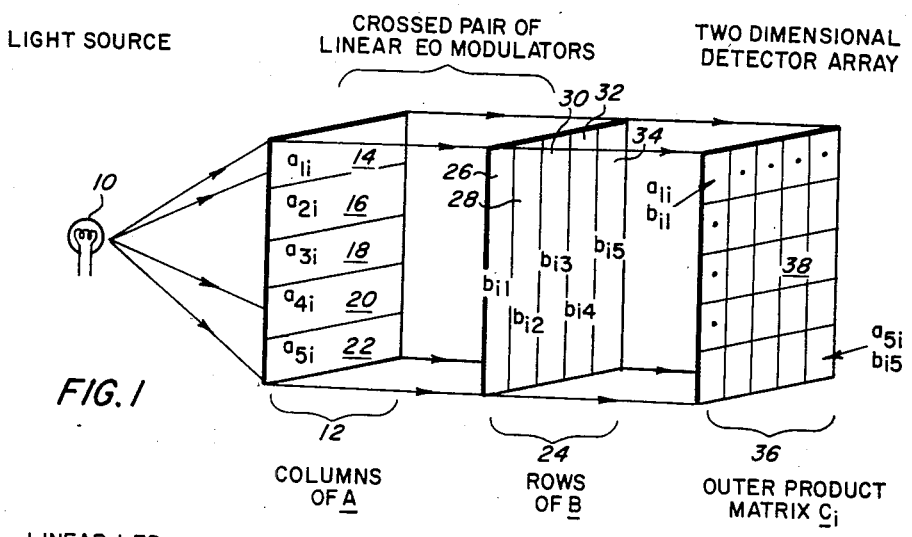
FIG. 1 is a pictorial representation of a first embodiment of the invention using two linear arrays of electro-optical modulators.

Referring now to the drawings, wherein like reference numerals designate identical or corresponding parts throughout the several views, and more particularly to FIG. 1 thereof.

The matrix-matrix multiplication represented by Eqn. (3) and implemented on the hitherto described multipliers are based on the inner product of the two vectors of the ith row of A and the jth column of B to produce the element $c_{ij}$ of the product matrix C. A matrix will be understood to be of order greater than 1, i.e. N>1, to exclude the trivial case of the multiplication of two scalar numbers with no attendant additions. Furthermore, the matrices are understood to be square. An alternative approach to inner product multiplication and the one used in this invention is to instead use the dimensionally increasing outer product of these two vectors. If the outer product matrix $C^{(n)}$ is defined as $$\underline{C}^{(n)} = \begin{pmatrix} a_{1n}b_{n1} & a_{1n}b_{n2} \cdots & a_{1n}b_{nN} \\ a_{2n}b_{n1} & a_{2n}b_{n2} \cdots & a_{2n}b_{nN} \\ \cdot & \cdot & \cdot \\ \cdot & \cdot & \cdot \\ \cdot & \cdot & \cdot \\ a_{Nn}b_{n1} & a_{Nn}b_{n2} \cdots & a_{Nn}b_{nN} \end{pmatrix} \quad (4)$$

each of the outer product matrices $C^{(n)}$ is seen to correspond to an outer product of the nth column vector of A and the nth row vector of B. It can be easily seen by inspecting the individual product elements that the product matrix C is equal to the sum of the N matrix terms, i.e.

$$\underline{C} = \sum_{n=1}^{N} \underline{C}^{(n)} \quad (5)$$

The outer product between the two vectors can be perfomed optically be crossing two linear light modulators as described by Tarasevich et al. in Optical Information Processing for Aerospace Applications, NASA Conference Publication 2207, pages 61–70, 1981. The summation is performed by a 2-dimensional photodetecting array that time integrates the intensities of light falling on each of the elements of the array as the modulators are stepped through the N-fold outer products. One of the modulating linear arrays is stepped through the columns of one matrix while the other modulating linear array is stepped through the rows of the other matrix. Additional optics may be required to obtain all $N^2$ paths through all combinations of modulating elements of the two linear arrays. Three separate embodiments of the invention will be presented.

The first embodiment shown in FIG. 1 has both matrices encoded on electrooptic modulators. A source of light 10 provides a constant and fairly uniform field of light to illuminate a first linear electrooptic array 12. The light source can be incoherent because coherency of the light is unimportant. The first linear electrooptic array 12 has at least as many elements as the order of the matrices to be multiplied, i.e. for N×N matrices the array 12 must have N elements. For all the embodiments N is set equal to 5 although much larger arrays can be bulit. Ueno et al. have described in Applied Optics, volume 19, number 1, pages 164–172, 1980 a 100 element spatial light modulator built of PLZT which has rise and fall times of 30 and 8 microseconds respectively at 190 V halfwave voltage. The individual elements 14, 16, 18, 20, and 22 of the linear array 12 are modulated according to the values of the elements of sequential columns of the matrix A. For example, in the ith summation step of Eqn. 5, the third element 18 is modulated by an amount proportional to the matrix element $a_{3i}$. As a result the intensity of light passing through the third element 18 during the ith step is made proportional to $a_{3i}$.

There will result N beams of light passing through the first electrooptic linear array 12. These N beams thereafter fall upon a second electrooptic linear array 24 of similar construction to the first array 12 except the pairs of arrays have a crossed or perpendicular orientation. Each of the N elements 26, 28, 30, 32, 34 have a vertical extent sufficient to intercept all N beams emanating from the first array. Similarly the elements 14, 16, 18, 20 and 22 of the first array must have sufficient horizontal extent to illuminate all the elements 26, 28, 30, 32 and 34 of the second array. Although both arrays 12 and 24 have been illustrated to have continuous and contiguous elements 14–22 and 26–34, there may be significant gaps between the active elements. Also FIG. 1 shows the first and second arrays 12 and 24 to be separated by a significant distance. In practice the two arrays can be closely spaced and even occupying the same structure, thus eliminating any need for focussing optics.

The combination of the crossed pair of linear electrooptic arrays 12 and 24, each having N elements, produces $N^2$ beams having different modulations according to which of the elements the beam has passed. For instance the beam passing through the third element 16 of the first array 12 and the fourth element 32 of the second array 24 during the ith step has an intensity proportional to $a_{3i}b_{i4}$.

The intensities of all the beams are simultaneously measured by a 2-dimensional N×N optical detector array 36. Each of the elements of the detector array 36 is disposed to receive one of the $N^2$ beams. For example, detecting element 38 measures the light passing through the third element 18 of the first modulating array 12 and the fourth element 32 of the second modulating array 24 so that during the ith step it is impinged by light of intensity $a_{3i}b_{i4}$. Each of the detecting elements of the detector array 36 is time integrating over the steps so that the final measured intensity of detecting element is proportional to the value of the corresponding element of the product matrix C. For example, detecting element 38 will measure an integrated light intensity proportional to $$\sum_{n=1}^{N} a_{3n}b_{n4}$$

Possible choices for the detector array are a chargecoupled device (CCD) array, a photodiode array, or a vidicon television camera.

The detector array 36 can be advantageously placed in close proximity to the second modulating array 24 or even included in a single integrated structure with the first and second modulating arrays 12 and 24.

Figure 2:
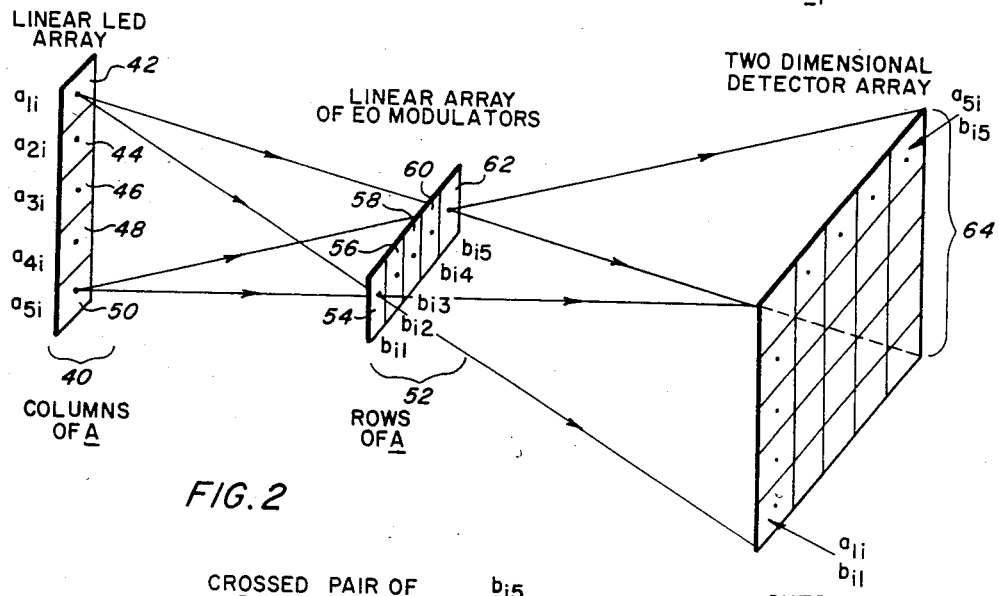
FIG. 2 is a pictorial representation of a second embodiment of the invention using a linear array of light emitting diodes and a linear array of electrooptical modulators.

A single narrow modulator can be used in the embodiment of the invention shown in FIG. 2. Instead of a single constant intensity light source, a linear array of modulated light sources 40 provides N sources of light where N is again chosen to be 5 for the illustration. The intensity of the N sources 42, 44, 46, 48, and 50 is independently modulated according the value of elements of one of the matrices to be multiplied. For instance, during the ith step of the summation the third light source 46 produces light of intensity proportional to $a_{3i}$.

The linear light sources array 40 can advantageously be a linear array of light emitting diodes (LEDs), each LED being independently controlled. The LEDs need not produce coherent radiation.

The light from all the light sources 42, 44, 46, 48 and 50 is directed toward a linear modulating array 52 of construction similar to those shown in FIG. 1. The orientation of the linear modulating array is perpendicular to that of the linear light source array, illustrated respectively as horizontal and vertical in FIG. 2. Again the linear modulating array 52 is composed of N electrooptic elements 54, 56, 58, 60 and 62, each individually controlled to modulate the absorption of light passing therethrough. The linear modulating array 52 differs the linear modulating arrays 12 and 24 of FIG. 1 in that the elements 54–62 need not be finger-like but may be point-like areas on the modulating array. The linear electrooptic array 52 is modulated according to the rows of the second matrix to be multiplied. Thus in the ith step, the fourth element 60 transmits a percentage of light proportional to $b_{i4}$. The intensity of light passed through the fourth element 60 that originated from the third LED element 46 is $a_{3i}b_{i4}$.

Although the invention of FIG. 2 could operate with properly sized elements or masks and no additional optics, efficient operation is also obtained by including optics between the two arrays 40 and 52 which focus the light from the linear light source array 40 as illustrated in FIG. 2, i.e. the light is focussed horizontally to diverge with a divergence angle that includes all of the linear modulating array 52. However, the light is focussed vertically to converge to a linear focus across the active areas of the linear modulating array 52. Such focussing is accomplished by anamorphic optics, i.e. lenses having different curvatures in different planes.

As a result of the hitherto described combination of arrays 40 and 52, each element of the modulating array 52 modulates the intensity of light from each of the light sources of the light source array 40. There results $N^2$ beams of light the intensity of which depend upon the light source producing it and the modulating element modulating its absorptions.

Each beam after passing through the linear modulating array is thereafter directed to its respective element of a 2-dimensional detector array, of construction similar to the detecting array shown in FIG. 1. There are $N^2$ elements on the detector array 64, each of which measures the time integrated intensity of the beam falling on that element. The element of the detecting array are individually read by associated electronic circuitry after the light source array 40 and the modulating array 52 have been simultaneously sequenced through the N steps corresponding to the summation of Eqn. (5). The intensity on an element of the detecting array is proportional to the corresponding element of the outer product matrix $C^{(i)}$ during the ith step. The integrated intensity on that element after the N steps is proportional to the corresponding element of the product matrix C.

Figure 3:
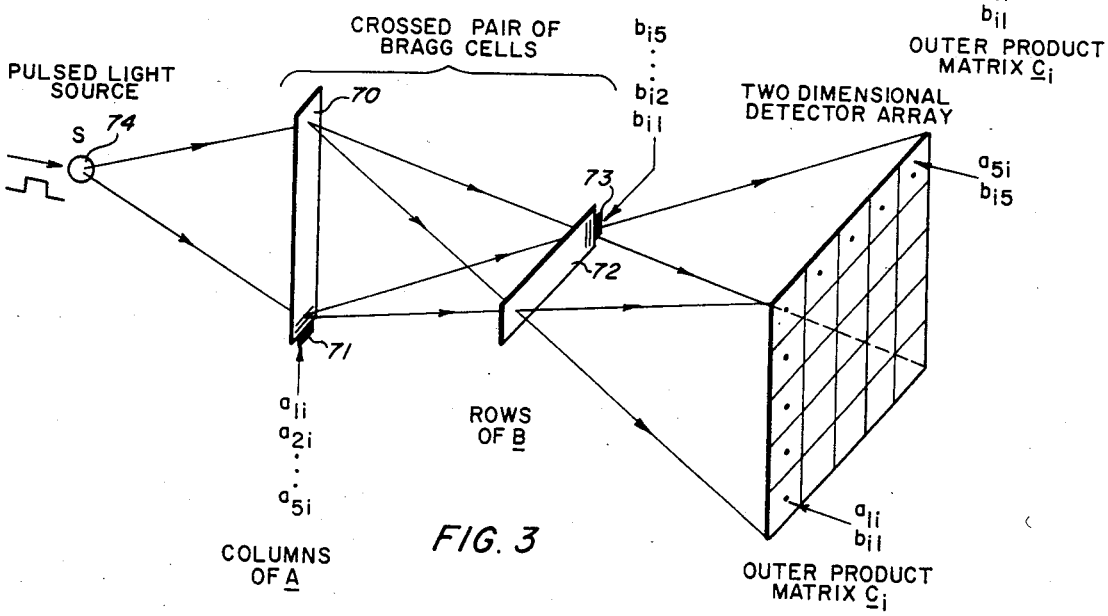
FIG. 3 is a pictorial representation of a third embodiment of the invention using two Bragg cells.

In a third embodiment shown in FIG. 3 the need for linear arrays of electrooptic modulating element in eliminated. In their place are used Bragg cells 70 and 72 each of which have a single transducer 71 or 73 on one end. The elements of a column of the matrix A modulate an RF carrier which controls the transducer 71 of one Bragg cell 70. Because of the finite velocity of the RF signal across the Bragg cell, proper timing and sequencing allows all the elements of a column of A to be represented simultaneously on the Bragg cell 70. Similarly all the elements of a row of the matrix B can be represented on the Bragg cell 72. Thus two series of elements of vectors of the respective matrices propagate across each of the Bragg cells 70 and 72. At a recording time, the entire vectors are present on extended portions of the respective Bragg cell 70 or 72, with each of the elements of the vectors represented in a smaller portion thereof. The two Bragg cells 70 and 72 are set at right angles to each others. When the Bragg cells 70 and 72 contain the ith column of A and the ith row of B respectively, then a light source 74 is pulsed on momentarily and illuminates the first cell 70 to effectively freeze the Bragg cells 70 and 72 at the instant when they contain a full column or row. The light upon passing the first array 0 is modulated by the values in the ith column of A. Thereafter anamorphic optics not shown in FIG. 3 serve to cause the light to converge vertically, i.e. in the direction of propagation of the first Bragg cell 70 but to diverge horizontally to cover the space on the second Bragg cell 72 occupied by the row of B.

A total of $N^2$ beams emerge from the second Bragg cell 72 and are imaged upon a 2-dimensional detector array 76. Each of the $N^2$ elements in the detector array is aligned to receive one of the beams and to independently measure the time-integrated intensity of that beam over N pulses of the light source 74. For each of those N light pulses, different columns of A and rows of B are led into the Bragg cells 70 and 72. Upon the completion of the N light pulses, the elements of the detector array 76 are individually read, the time-integrated intensities being proportional to the corresponding elements of the product matrix C.

Although all the embodiments described have modulated the A matrix before the modulation of the B matrix it is to be appricated that the order can be reversed. Both the columns of A are vectors and the rows of B are vectors, although perpendicularly located in the respective matrices. Either the A column vector or B row vector can be used to perform either modulation if the two vectors on the respective modulators are like numbered during each step. In other words, the ith column vector of A and the ith row vector of B need to simultaneously exist on both modulators. Using the row vectors of A and the column vectors of B will on the other hand result in the product B A rather than A B.

The embodiments hitherto described can multiply only matrices composed of positive real elements. Standard techniques are available and well known in the optical processing field to enable incoherent light processors to operate on negative and even complex values. Such techniques can be benficially used with this invention.

It will be possible for the invention shown in FIG. 3 and using a vidicon television camera for the detector array 76 to multiply two positive $1000 \times 1000$ matrices in 30 milliseconds to an accuracy of 8 bits. This matrix multiplication corresponds to $3 \times 10^{10}$ multiplications and additions per second, speeds unattainable with electronic means. These speeds are attainable because the optical multiplier of this invention performs $N^2$ multiplies and $N^2$ additions in parallel. In the N clock cycles necessary to perform the summation of Eqn. (5), $N^3$ multiplications and additions are performed.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An optical multiplier of two matrices of vectors, comprising:

N sources of light where N is greater than one and is equal to the order of both matrices, each said source of light being modulated according to a first vector of a first matrix to be multiplied, said N sources of light forming a line with each source of light being next to at least one other source of light;

a first set of N optical modulators for modulating, according to a second vector of a second matrix to be multiplied, the intensity of light passing therethrough that has originated from the N source of light, said second vector being perpendicular to said first vector and said first set of N optical modulators forming a line with each optical modulator being next to at least one other optical modulator, said first set of N optical modulators disposed so that light originating from the N sources of light passes through said first set of N optical modulators;

means for sequencing by column order all N first vectors of said first matrix on the N sources of light and sequencing by row order all N second vectors of said second matrix on the optical modulators, said two vectors being like numbered at corresponding times in the sequence; and $N^2$ optical detectors disposed so that each said detector receives a beam from a unique combination of light source and modulator, each said optical detector integrating over the N-fold sequence the light intensity of the beam impinging thereupon.

2. An optical multiplier of two matrices, as recited in claim 1, wherein the N sources of light are contained in an integrated array of independently controlled light emitting sources.

3. An optical multiplier of two matrices, as recited in claim 1, wherein the first set of N optical modulators comprises a Bragg cell and means for simultaneously impressing N modulations upon different areas of said Bragg cell and including means for pulsing the N sources of light.

4. An optical multiplier of two matrices of vectors comprising:

one source of light of substantially constant intensity;

a first set of N optical modulators for modulating, according to a first vector of a first matrix to be multiplied, the intensity of light passing therethrough that has originated from the one source of light, said first set of, said N optical modulators forming a line with each modulator being next to at least one other modulator, said N optical modulators disposed to receive light from said one source of light;

a second set of N optical modulators for modulating, according to a second vector of a second matrix to be multiplied, the intensity of light passing therethrough that has originated from the one source of light and has passed through the first set of N optical modulators, said second vector being perpendicular to said first vector and said second set of N optical modulators forming a line with each optical modulator being next to at least one other optical modulator, the second set of N optical modulators disposed so that light originating from the one source of light passes through the first set of N optical modulators and then passes through the second set of modulators;

means for sequencing by column order all N first vectors of said first matrix on the first set of N optical modulators and sequencing by row order all N second vectors of said second matrix on the second set of N optical modulators, said two vectors being like numbered at corresponding times in the sequence; and $N^2$ optical detectors disposed so that each said detector receives a beam from a unique combination of the first and second sets of N optical modulators, each said optical detector integrating over the N-fold sequence the light intensity of the beam impinging thereupon.

5. An optical multiplier of two matrices, comprising:

a source of light;

a first linear electrooptic array of elements disposed to receive light from said source of light;

a second linear electrooptic array of elements disposed so that light from said source passing through each element of said first array passes through each element of said second array;

a detector array disposed so that light passing through each unique combination of an element of said first linear electrooptic array and an element of said second linear electrooptic array impinges a separate element of said detector array, each said element of said detector array measuring the time integrated intensity of light impinging thereupon;

means for impressing upon said first linear electrooptic array a sequence of first vectors from one of the matrices to be multiplied; and means for impressing upon said second linear electrooptic array a sequence of second vectors, perpendicular to said first vectors, from the other of the matrices to be multiplied, said first and second vectors being like numbered when simultaneously present on said first and second linear electrooptic arrays.

6. An optical multipler of two matrices, comprising:

a linear array of emitting light sources;

a linear electrooptic array of elements disposed so that light from each element of said array of light sources passes through each element of said linear electrooptic array;

a detector array of elements disposed so that light from each unique combination of an element of said array of light sources and an element of said linear electrooptic array impinges upon a separate element of said detector array, each said element of said detector array measuring the time integrated intensity of light impinging thereupon;

means for controlling the intensities of the elements of said linear array of emitting light sources according to a sequence of first vectors from one of the matrices to be multiplied;

means for impressing upon said linear electrooptic array a sequence of second vectors, perpendicular to said first vectors, from the other of said matrices to be multiplied, said first and second vectors being like numbered when simultaneously present on the linear array of emitting light sources and the linear electrooptic array.

7. An optical multiplier of two matrices, as recited in claim 6, wherein the linear array of emitting light sources is an array of light emitting diodes.

8. An optical multiplier of two matrices, comprising:

a light source that can be pulsed on for a fixed period of time;

a first Bragg cell disposed to receive light over an extended portion thereof from said light source, said extended portion comprising a first series of discrete sections arranged linearly along the length of the extended portion;

a second Bragg cell disposed to receive light over an extended portion thereof from an extended portion of said first Bragg cell;

said extended portion of said second Bragg cell comprising a second series of discrete sections arranged linearly along the length of the extended portion of said second Bragg cell;

a detector array disposed to receive on separate elements of said detector array light passing through combinations of the discrete sections of the extended portions of said first Bragg cell and thence through a discrete section of the extended portion of said second Bragg cell, each said element of said detector array measuring the time integrated intensity of light impinging thereupon;

means for impressing upon said first Bragg cell a series of modulating signals according to a vector in a first sequence of vectors of one of the matrices to be multiplied, said series propagating across the extended portion of said first Bragg cell and contained thereon at one of a sequence of recording times;

means for impressing upon second said Bragg cell a series of modulating signals according to a vector in a second sequence of vectors of the other of the matrices to be multiplied, said series propagating across the extended portion of said second Bragg cell and contained thereon at one of the sequence of recording times, said vector in the second sequence of vectors being perpendicular to the vector in the first sequence of vectors, the vectors in the two sequences of vectors being like numbered for each of the recording times; and means for pulsing the light source at each of the sequence of recording times.

9. A method of multiplying two $N \times N$ matrices, comprising the steps of:

modulating N beams of light according to the N elements of a first vector of one of the matrices to be multipled;

directing each of the N modulated beams through each of N modulators;

modulating said N modulators according to the N elements of a second vector of the other of the matrices to be multiplied, said second vector being perpendicular to said first vector and like numbered;

integrating the intensity of each of the $N^2$ product beams formed by the N modulated beams passing through each of the N modulators; and repeating the preceding steps for all N pairs of vectors in the two matrices;

whereby each of the $N^2$ integrated intensities is proportional to an element of the product matrix.

* * * * *